US007098595B2

(12) United States Patent
Jang et al.

(10) Patent No.: US 7,098,595 B2
(45) Date of Patent: Aug. 29, 2006

(54) PLASMA DISPLAY PANEL

(75) Inventors: Sang-hun Jang, Yongin-si (KR); Hidekazu Hatanaka, Seongnam-si (KR); Young-mo Kim, Suwon-si (KR); Seong-eui Lee, Seongnam-si (KR); Xiaoqing Zeng, Yongin-si (KR); Seung-hyun Son, Hwaseong-si (KR); Gi-young Kim, Chungiu-si (KR); Hyoung-bin Park, Seongnam-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/963,637

(22) Filed: Oct. 14, 2004

(65) Prior Publication Data

US 2005/0082981 A1 Apr. 21, 2005

(30) Foreign Application Priority Data

Oct. 16, 2003 (KR) ..... 10-2003-0072137

(51) Int. Cl.
*H01J 17/49* (2006.01)

(52) U.S. Cl. ..... 313/587; 313/586; 313/485

(58) Field of Classification Search ..... 313/582, 313/584–587, 484–487; 315/169.4; 345/41, 345/37, 60

See application file for complete search history.

(56) References Cited

U.S. PATENT DOCUMENTS

| | | | | |
|---|---|---|---|---|
| 5,828,356 | A * | 10/1998 | Stoller | 345/60 |
| 6,437,507 | B1 * | 8/2002 | Ha | 313/587 |
| 6,501,447 | B1 * | 12/2002 | Kang et al. | 345/67 |
| 6,525,470 | B1 * | 2/2003 | Amemiya | 313/586 |
| 2003/0062837 | A1 * | 4/2003 | Shin et al. | 313/585 |

* cited by examiner

*Primary Examiner*—Ashok Patel
*Assistant Examiner*—C. Raabe
(74) *Attorney, Agent, or Firm*—H.C. Park & Associates, PLC

(57) ABSTRACT

A plasma display panel including front and rear substrates facing each other to form a discharge space therebetween; a plurality of address electrodes on an upper surface of the rear substrate; a first dielectric layer covering the address electrodes on the upper surface of the rear substrate; partitions provided on a upper surface of the first dielectric layer to partition the discharge space; a plurality of second dielectric layers provided on a lower surface of the front substrate and extending in a direction perpendicular to the address electrodes; first and second sustaining electrodes provided to be slanted to face each other on both sides of each of the second dielectric layers; a third dielectric layer provided on a lower surface of the second dielectric layers to cover the first and second sustaining electrodes; and a protective layer provided on a lower surface of the third dielectric layer.

17 Claims, 5 Drawing Sheets

PLASMA DISPLAY PANEL

CROSS REFERENCE TO RELATED APPLICATION

This application claims the priority of Korean Patent Application No. 10-2003-0072137, filed on Oct. 16, 2003, which is hereby incorporated by reference for all purposes as if fully set forth herein.

BACKGROUND OF THE INVENTION

1. Field of the Invention

The present invention relates to a plasma display panel (PDP), and more particularly, to a PDP having a slanted pair of sustaining electrodes that face each other on a front substrate to generate efficient plasma discharges.

2. Discussion of the Related Art

A PDP, which uses electrical discharges to form an image, is a bright display with a wide viewing angle. In the PDP, applying a DC or AC voltage to the electrodes generates a gas discharge in a gas between electrodes, thereby creating ultraviolet rays that excite a fluorescent material to emit visible light.

Plasma display panels are classified into direct current (DC) and alternating current (AC) PDPs depending upon driving waveform shapes and discharge cell structures. In a DC PDP, the electrodes are exposed in a discharge space, and electrical charges directly moving between electrodes generate a discharge. On the other hand, in an AC PDP, at least one electrode is covered with a dielectric layer, and wall charges generate a discharge instead of the electrical charges directly moving between the electrodes.

Additionally, PDPs may be classified into facing and surface discharge PDPs depending on the arrangement of electrodes. In a facing discharge PDP, two sustaining electrodes provided on front and rear substrates, respectively, face each other, and a discharge is generated in a direction perpendicular to the substrates. On the other hand, in a surface discharge PDP, a pair of sustaining electrodes is provided on the same substrate, and a discharge is generated between the pair of electrodes and parallel to a surface of the substrate.

Although it has high luminous efficiency, plasma particles may easily deteriorate the facing discharge PDP's fluorescent layer. Therefore, the surface discharge PDP has been mainly used.

FIG. 1 and FIG. 2 illustrate a conventional surface discharge PDP. In FIG. 2, a front substrate 20 is rotated 90° in order to more clearly show an internal structure of the PDP.

Referring to FIGS. 1 and 2, the conventional PDP may include rear and front substrates 10 and 20 facing each other.

A plurality of address electrodes 11 is provided in stripes on an upper surface of the rear substrate 10. The address electrodes 11 are covered by a first dielectric layer 12 made of a white dielectric material. A plurality of partitions 13 is provided at a predetermined interval on an upper surface of the first dielectric layer 12 in order to prevent electrical or optical crosstalk between discharge cells 14. Red (R), green (G) and blue (B) fluorescent layers 15 having a predetermined thickness are coated on inner surfaces of respective discharge cells 14 defined by the partitions 13. The discharge cells 14 are filled with a discharge gas, which is typically a mixture of Ne and Xe.

The transparent front substrate 20 is may be mostly made of glass, allowing visible light to pass. The front substrate 20 is sealed together with the rear substrate 10 provided with the partitions 13. Stripe-shaped pairs of sustaining electrodes 21*a* and 21*b* are provided on a lower surface of the front substrate 20 and are orthogonal to the address electrodes 11. The sustaining electrodes 21*a* and 21*b* may be made of a transparent, conductive material such as indium tin oxide (ITO), which is capable of passing visible light. Metal bus electrodes 22*a* and 22*b* are provided on lower surfaces of the sustaining electrodes 21*a* and 21*b* to reduce the line resistance of the sustaining electrodes 21*a* and 21*b*. The sustaining electrodes 21*a* and 21*b* and bus electrodes 22*a* and 22*b* are covered by a transparent second dielectric layer 23. A protective layer 24, typically made of magnesium oxide (MgO), is provided on a lower surface of the second dielectric layer 23. The protective layer 24 prevents sputtered plasma particles from deteriorating the second dielectric layer 23, and it reduces discharge and sustaining voltages by emitting secondary electrons.

Driving schemes of the conventional PDP having the above structure may be classified as address and sustaining driving schemes. In the address driving schemes, an address discharge is generated between the address electrode 11 and one sustaining electrode 21*a*, to form wall charges. On the other hand, in the sustaining driving scheme, a sustaining discharge is generated by a potential difference between the sustaining electrodes 21*a* and 21*b* in a discharge space where wall charges are formed. Ultraviolet rays emitted from a discharge gas during the sustaining discharge excite the fluorescent layer 15 in the discharge cell 14 to emit visible light. The visible light passes through the front substrate 20 to form an image on the display.

In the conventional PDP having the above structure, a gap exists between the sustaining electrodes 21*a* and 21*b* in order to generate a highly efficient plasma discharge. However, if the gap is too wide, a sustaining discharge voltage increases. Additionally, an address discharge voltage must also increase in order to accumulate sufficient wall charges.

SUMMARY OF THE INVENTION

The present invention provides a PDP capable of efficiently generating a plasma discharge by forming a pair of sustaining electrodes to be slanted to face each other on a front substrate.

Additional features of the invention will be set forth in the description which follows, and in part will be apparent from the description, or may be learned by practice of the invention.

The present invention discloses a plasma display panel, comprising a front substrate and a rear substrate with a discharge space therebetween, a plurality of address electrodes on an upper surface of the rear substrate, a first dielectric layer covering the plurality of address electrodes, and partitions provided on a upper surface of the first dielectric layer. A plurality of second dielectric layers protrudes from a lower surface of the front substrate and extends in a direction perpendicular to the address electrodes, first sustaining electrodes and second sustaining electrodes are formed on sides of the plurality of second dielectric layers and slanted to face each other. A third dielectric layer is provided on a lower surface of the plurality of second dielectric layers to cover the first sustaining electrodes and the second sustaining electrodes, and a protective layer is provided on a lower surface of the third dielectric layer.

The present invention also discloses a plasma display panel, comprising a first substrate and protrusions formed on the first substrate and having a first side and a second side.

A first sustaining electrode is formed on the first side and a second sustaining electrode formed on the second side. The first side of a first protrusion and the second side of a second protrusion form a discharge cell, and the first sustaining electrode of the first protrusion and the second sustaining electrode of the second protrusion slant to face each other in the discharge cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
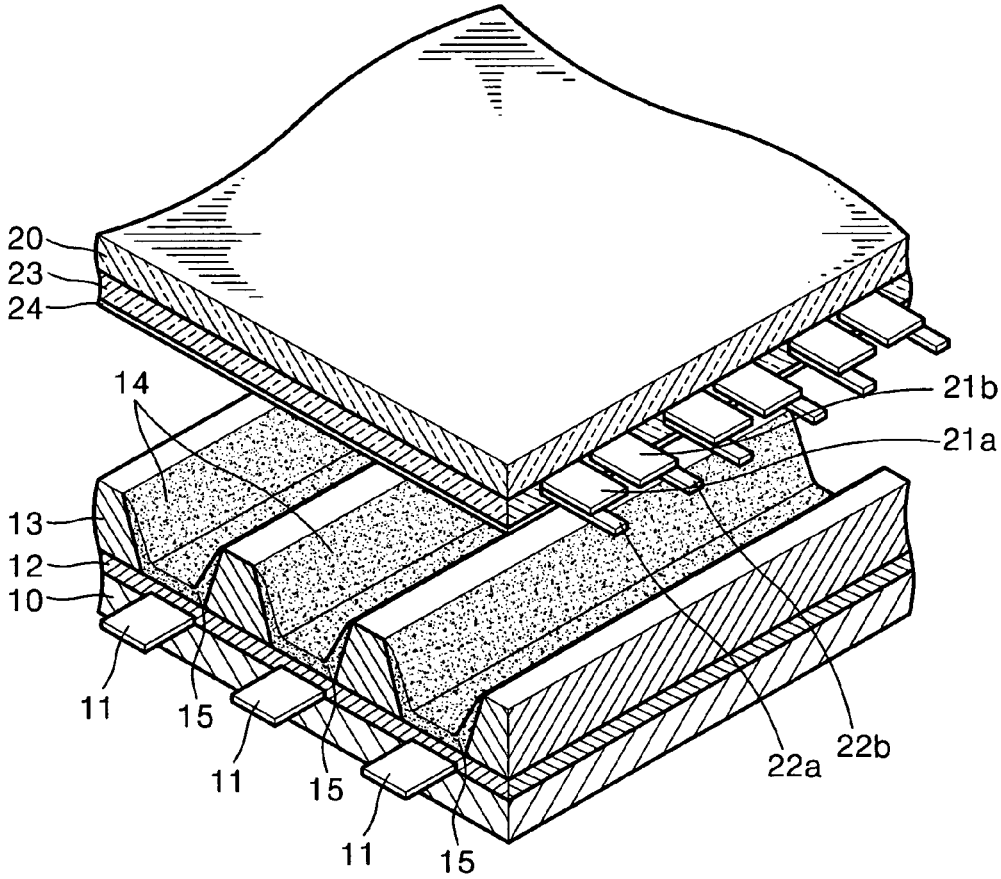
FIG. 1 (PRIOR ART)
FIG. 1 is an exploded perspective view of a conventional surface discharge PDP.
Figure 2:
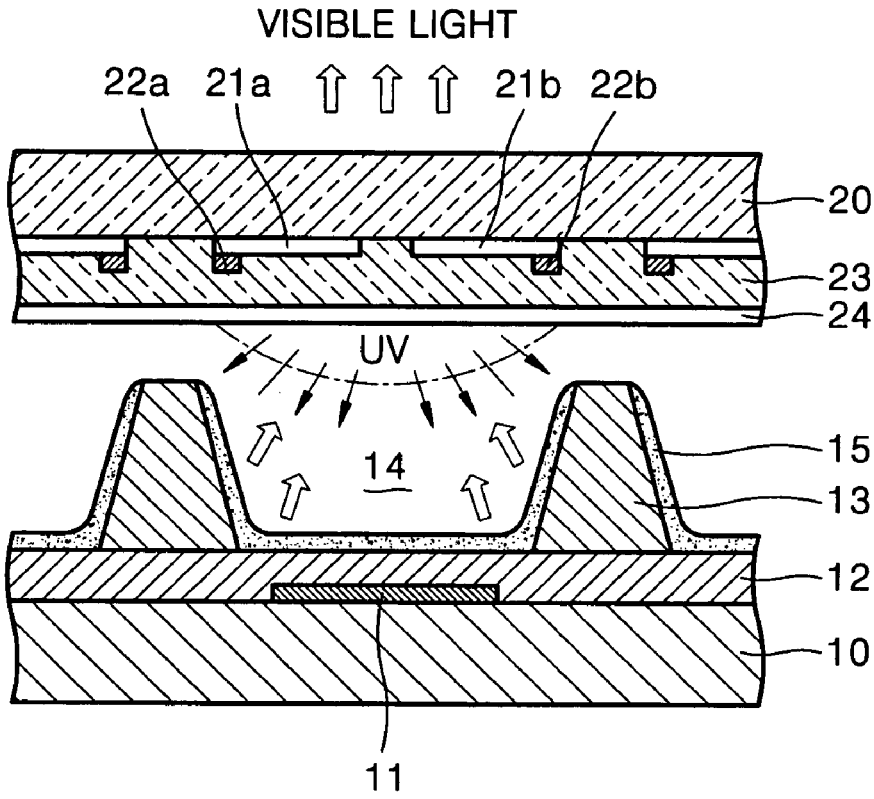
FIG. 2 (PRIOR ART)
FIG. 2 is a cross sectional view of the PDP of FIG. 1.

The following paragraphs describe exemplary embodiments of the present invention with reference to the attached drawings. Like reference numerals in the drawings denote like elements.

Figure 3:
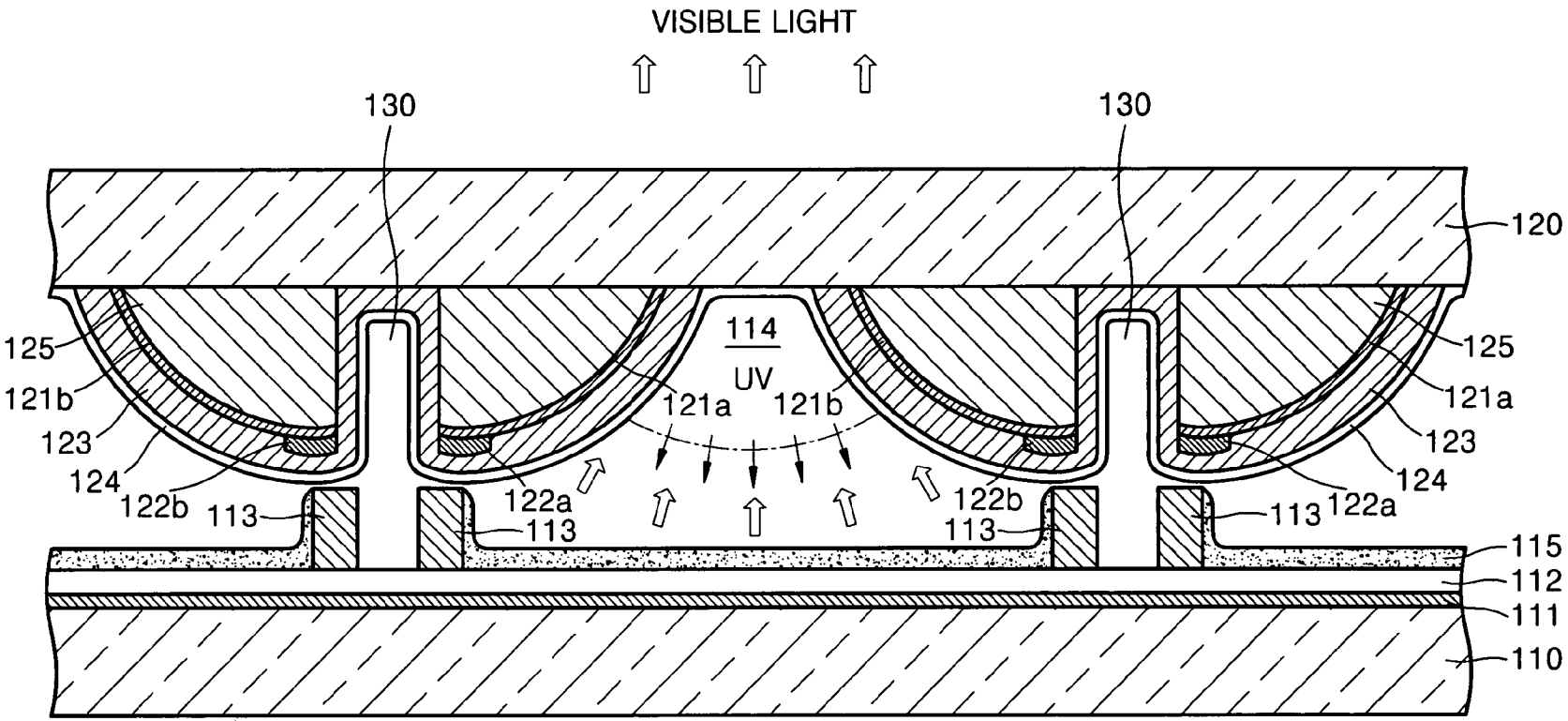
FIG. 3 is a cross sectional view of a PDP according to a first exemplary embodiment of the present invention.

FIG. 3 is a cross sectional view of a PDP according to a first exemplary embodiment of the present invention.

The PDP according to the first exemplary embodiment of the present invention includes rear and front substrates 110 and 120 facing each other. Plasma discharges are generated in a discharge space between the rear and front substrates 110 and 120.

A plurality of stripe-shaped address electrodes 111 is provided on an upper surface of the rear substrate 110, which may be a glass substrate. A first dielectric layer 112 is provided on the upper surface of the rear substrate 110 to cover the address electrodes 111. The first dielectric layer 112 may be formed by depositing a white dielectric material on the upper surface of the rear substrate 110.

A plurality of partitions 113, which define the discharge cells 114 in the discharge space, is provided in a predetermined interval on an upper surface of the first dielectric layer 112. The partitions 113 prevent electrical or optical crosstalk between the discharge cells 114. A plurality of second dielectric layers 125, protruding from a lower surface of the front substrate 120, is provided at positions corresponding to the partitions 113. A trench 130 may be provided on a top plane of each of the partitions 113. Each of the partitions 113 may be formed with a lower height than those of a conventional PDP. Since the height of each partition 113 may be reduced as much as the protruded length of the corresponding second dielectric layer 125, the discharge cells 114 of the first exemplary embodiment may be the same size as discharge cells of the conventional PDP. The discharge cells 114 are filled with a discharge gas such as Ne, Xe, or a mixture of Ne and Xe. Red (R), green (G) and blue (B) fluorescent layers 115 may be coated on the upper surface of the first dielectric layer 112 and sidewalls of the partitions 113.

The plurality of second dielectric layers 125 is provided on the lower surface of the front substrate 120, which may be a transparent substrate primarily made of glass. The second dielectric layers 125 protrude from the lower surface of the front substrate 120, and they are formed orthogonally to the address electrodes 111. As described above, the second dielectric layers 125 face the corresponding partitions 113. Therefore, the discharge cells 114 are formed between adjacent second dielectric layers 125. A width of the second dielectric layers 125 gradually decreases in a direction from the front substrate 120 to the rear substrate 110. In the first exemplary embodiment of the present invention, both sides of the second dielectric layers 125 are convexly curved. A trench 130 extends in a longitudinal direction of the second dielectric layers 125 at a center of a top plane thereof. The trench 130 may correspond to the trench provided on the top plane of each of the partitions 113, and it may function as a passage for the discharge gas, as well as a passage for heat generated during a plasma discharge. Additionally, the trench 130 may function as a black stripe for improving the PDP's contrast. The second dielectric layers 125 may be formed without the trench 130.

A pair of first and second sustaining electrodes 121*a* and 121*b* is provided on each of the second dielectric layers 125. Since one sustaining electrode is provided on both of the convexly-curved sides, the first and second sustaining electrodes 121*a* and 121*b* slant to face each other in the discharge cell 114. The first and second sustaining electrodes 121*a* and 121*b* may be made of a transparent material, such as ITO. Since ITO has a high resistance, first and second bus electrodes 122*a* and 122*b*, made of a conductive metal, are provided on the lower surfaces of the first and second sustaining electrodes 121*a* and 121*b* in order to reduce their line resistance.

A transparent third dielectric layer 123 covers the first and second sustaining electrodes 121*a* and 121*b* and the first and second bus electrodes 122*a* and 122*b*.

A protective layer 124 is provided on a lower surface of the third dielectric layer 123 to prevent plasma particle sputtering from deteriorating the third dielectric layer 123 and the first and second sustaining electrodes 121*a* and 121*b*. Additionally, the protective layer 124 reduces discharge and sustaining voltages by emitting secondary electrons. The protective layer 124 may be formed by depositing MgO on the lower surface of the third dielectric layer 123.

With the PDP according to the first exemplary embodiment, the address discharge is generated between the address electrodes 111 and one of the first and second sustaining electrodes 121*a* and 121*b* to form wall charges on the third dielectric layer 123. Next, a voltage difference between the first and second sustaining electrodes 121*a* and 121*b* generates the sustaining discharge in selected discharge cells 114. Since the first and second sustaining electrodes 121*a* and 121*b* slant to face each other in the discharge cells 114, a slanted sustaining discharge may be induced. Even when a wide gap exists between the first and second sustaining electrodes 121*a* and 121*b*, the sustaining discharge may be smoothly generated since they slant to face each other. Additionally, since the first and second bus electrodes 122*a* and 122*b* are located near address electrodes, the address discharge may be smoothly generated.

Figure 4:
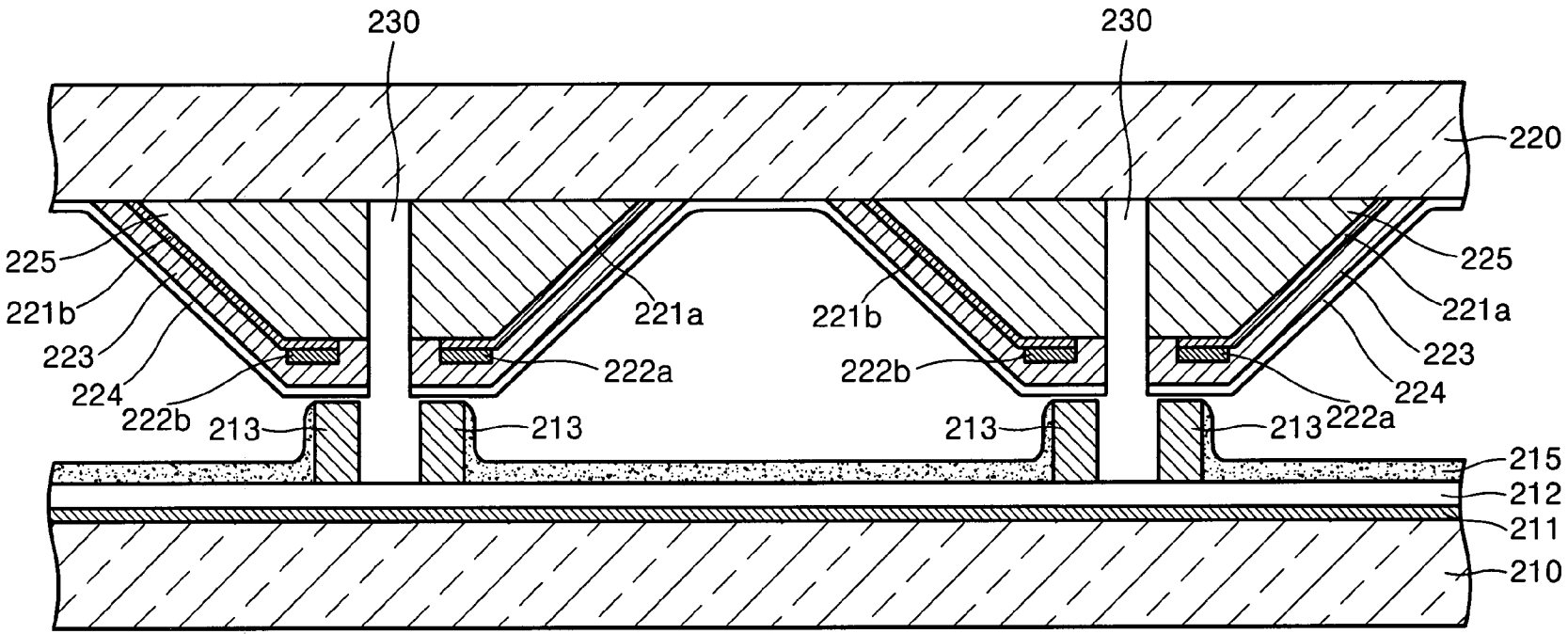
FIG. 4 is a cross sectional view of a PDP according to a second exemplary embodiment of the present invention.

FIG. 4 is a cross sectional view of a PDP according to a second exemplary embodiment of the present invention.

Referring to FIG. 4, the second exemplary embodiment differs from the first exemplary embodiment in the shape of the second dielectric layers 225 and the subsequent layers formed thereon. Specifically, in the second exemplary embodiment, sides of the dielectric layers 225 slant with a certain angle to face each other in the discharge space.

With such an arrangement, since the first and second sustaining electrodes 221*a* and 221*b*, which are formed on the second dielectric layers 225, slant to face each other in the discharge space, a slanted sustaining discharge may be induced.

Figure 5:
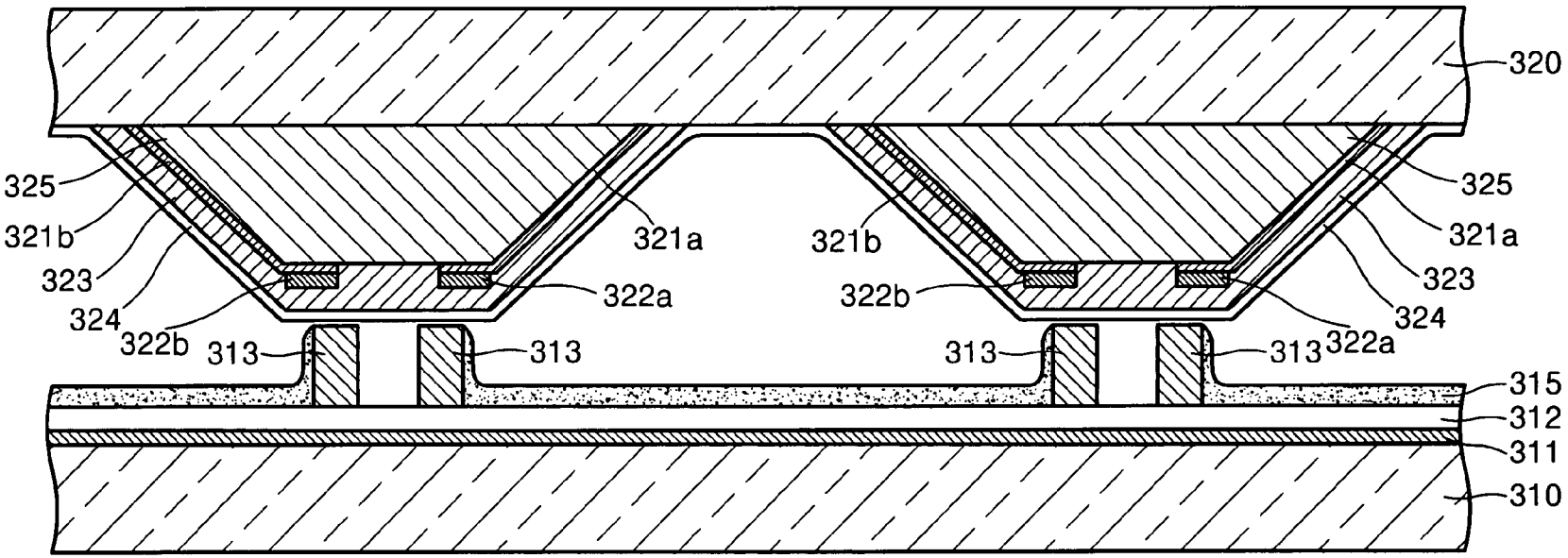
FIG. 5 is a cross sectional view of a PDP according to a third exemplary embodiment of the present invention.

FIG. 5 is a cross sectional view of a PDP according to a third exemplary embodiment of the present invention.

As is the case with the first and second exemplary embodiments, a width of the second dielectric layers 325 narrows in a direction from the front substrate 320 to the rear substrate 310. And similar to the second exemplary embodiment, the sides of the second dielectric layers 325 slant with a certain angle to face each other in the discharge cell. Unlike the first two exemplary embodiments, however, trenches are not formed in the second dielectric layers 325. Hence, the second dielectric layers 325 may be integrally formed with the front substrate 320.

With such an arrangement, since the first and second sustaining electrodes 321*a* and 321*b* slant to face each other, a slanted sustaining discharge may be induced.

A PDP according to the present invention may have the following advantages.

First, since a pair of sustaining electrodes slant to face each other on a front substrate, a sustaining discharge may be smoothly generated even when a wide gap exists between the electrode pair. Therefore, it may be possible to improve luminous efficiency and brightness of a PDP.

Second, since bus electrodes are located near address electrodes, an address discharge may be smoothly generated. Therefore, it may be possible to reduce an address discharge voltage.

Third, since a height of each partition may be reduced as much as a protruded length of a corresponding second dielectric layer, it may be possible to obtain discharge cells having the same size as that of a conventional PDP.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a front substrate and a rear substrate with a discharge space therebetween;

a plurality of address electrodes on an upper surface of the rear substrate;

a first dielectric layer covering the plurality of address electrodes;

partitions provided on a upper surface of the first dielectric layer;

a plurality of second dielectric layers protruding from a lower surface of the front substrate and extending in a direction perpendicular to the address electrodes;

first sustaining electrodes and second sustaining electrodes formed on sides of the plurality of second dielectric layers and slanted to face each other;

a third dielectric layer provided on a lower surface of the plurality of second dielectric layers to cover the first sustaining electrodes and the second sustaining electrodes; and a protective layer provided on a lower surface of the third dielectric layer, wherein the plurality of second dielectric layers have a trench between the first sustaining electrodes and the second sustaining electrodes, the trench being arranged between adjacent discharge cells.

2. The PDP of claim 1, wherein a width of a second dielectric layer narrows in a direction from the front substrate to the rear substrate.

3. The PDP of claim 2, wherein a side of the second dielectric layer is convexly curved.

4. The PDP of claim 2, wherein a side of the second dielectric layer is slanted with a certain angle.

5. The PDP of claim 1, further comprising:

first bus electrodes provided on a lower surface of the first sustaining electrodes; and second bus electrodes provided on a lower surface of the second sustaining electrodes.

6. The PDP of claim 1, wherein the plurality of second dielectric layers are provided at positions opposite to corresponding partitions.

7. The PDP of claim 1, wherein a trench is provided on a top plane of the partitions corresponding to the trench of the plurality of second dielectric layers.

8. A plasma display panel, comprising:

a first substrate;

protrusions formed on the first substrate and having a first side and a second side; and a first sustaining electrode formed on the first side and a second sustaining electrode formed on the second side, wherein the first side of a first protrusion and the second side of a second protrusion form a discharge cell, wherein the first sustaining electrode of the first protrusion and the second sustaining electrode of the second protrusion slant to face each other in the discharge cell, and wherein the first protrusion has a trench between its first side and its second side, and the second protrusion has a trench between its first side and its second side.

9. The PDP of claim 8, wherein a width of the protrusions decreases in a direction away from the first substrate.

10. The PDP of claim 9, wherein the first side and the second side have a convex shape.

11. The PDP of claim 9, wherein the first side and the second side are straight and not parallel to the first substrate.

12. The PDP of claim 8, wherein the protrusions are made of a dielectric material.

13. The PDP of claim 8, further comprising:

a first bus electrode formed on a lower portion of the first sustaining electrode;

a second bus electrode formed on a lower portion of the second sustaining electrode;

a first dielectric layer covering the first and second sustaining electrodes and the first and second bus electrodes; and a protection layer covering the first dielectric layer.

14. The PDP of claim 13, further comprising:

a second substrate;

address electrodes formed on the second substrate;

a second dielectric layer covering the address electrodes; and partitions formed on the second dielectric layer at positions corresponding to the protrusions, wherein the address electrodes are formed orthogonally to the protrusions.

15. The PDP of claim 14, wherein the trench in the first protrusion is aligned with a first trench between adjacent partitions, and the trench in the second protrusion is aligned with a second trench between adjacent partitions, when the first substrate and the second substrate are sealed together.

16. A plasma display panel (PDP), comprising:

a front substrate and a rear substrate with a discharge space therebetween;

a plurality of address electrodes on an upper surface of the rear substrate;

a first dielectric layer covering the plurality of address electrodes;

partitions provided on a upper surface of the first dielectric layer;

a plurality of second dielectric layers protruding from a lower surface of the front substrate and extending in a direction perpendicular to the address electrodes;

first sustaining electrodes and second sustaining electrodes formed on sides of the plurality of second dielectric layers and slanted to face each other;

a third dielectric layer provided on a lower surface of the plurality of second dielectric layers to cover the first sustaining electrodes and the second sustaining electrodes; and a protective layer provided on a lower surface of the third dielectric layer, wherein the partitions have a trench, the trench being arranged between adjacent discharge cells and aligned with a gap between a first sustaining electrode and a second sustaining electrode of the same second dielectric layer when the front substrate and the rear substrate are sealed together.

17. The PDP of claim 16, wherein the plurality of second dielectric layers are integrally formed with the front substrate.

* * * * *